United States Patent [19]

Morooka

[11] Patent Number: 4,625,536

[45] Date of Patent: Dec. 2, 1986

[54] METHOD OF CONTROLLING UNEQUAL CIRCUMFERENTIAL SPEED ROLLING

[75] Inventor: Yasuo Morooka, Hitachi, Japan

[73] Assignee: Hitachi, Ltd., Tokyo, Japan

[21] Appl. No.: 689,941

[22] Filed: Jan. 9, 1985

[30] Foreign Application Priority Data

Jan. 11, 1984 [JP] Japan ..... 59-2008

[51] Int. Cl.[4] ..... B21B 35/06; B21B 37/12

[52] U.S. Cl. ..... 72/249; 72/8; 72/11; 72/16; 72/17; 72/21; 72/205; 72/366; 364/472

[58] Field of Search ..... 72/6, 8, 16, 17, 20, 72/21, 205, 365, 366, 249, 11; 364/472

[56] References Cited

U.S. PATENT DOCUMENTS 3,841,122 10/1974 Fox et al. ..... 72/6

4,173,133 11/1979 Imai et al. ..... 72/8

4,382,375 5/1983 Yamamoto et al. ..... 72/205

4,414,832 11/1983 Brenneman et al. ..... 72/8

4,512,169 4/1985 Miura ..... 72/8 X

*Primary Examiner*—Francis S. Husar

*Assistant Examiner*—Steve Katz

*Attorney, Agent, or Firm*—Antonelli, Terry & Wands

[57] ABSTRACT

A set-up method for unequal speed circumferential rolling. The setting values of the circumferential speeds of a higher speed roll and a lower speed roll and the roll position are obtained by using, as rolling parameters in a rolling schedule, the inlet and outlet thicknesses, the forward and backward tensions, the radii of the rolls, the frictional coefficients and the ratio of the circumferential speeds of the rolls. The setting values are computed such that these values meet the rolling conditions within both the load limit value and the tension limit value.

5 Claims, 11 Drawing Figures

| | A | B | C | D | E | F |
|---|---|---|---|---|---|---|
| $t_b$ | 5.0 | 10.0 | 20.0 | 20.0 | 20.0 | 5.0 |
| $t_f$ | 21.2 | 20.0 | 20.0 | 15.0 | 10.0 | 40.0 |

| | H | h | tf | tb |
|---|---|---|---|---|
| A | 0.35 | 0.20 | 20 | 10 |
| B | 0.50 | 0.35 | 20 | 5 |
| C | 0.50 | 0.35 | 20 | 10 |
| D | 0.50 | 0.35 | 15 | 10 |

METHOD OF CONTROLLING UNEQUAL CIRCUMFERENTIAL SPEED ROLLING

BACKGROUND OF THE INVENTION

1. Field of the Invention

This invention relates to a method of controlling a rolling mill, and more particularly to a method of setting and controlling unequal circumferential speed rolling which uses a rolling mill with work rolls rotating at different circumferential speeds.

Usually, a rolling mill is operated with the upper and lower work rolls rotating at the same revolution speed and a possible thickness limit of rolled sheet is several hundred micrometers at the thinnest. However, recently a rolled sheet thinner than this limit has been in demand, and it has been said that unequal circumferential speed rolling is suitable for a rolling method which will meet this current demand.

However, a control method for this unequal circumferential speed rolling has not been established yet. In order to establish a computer system for the unequal circumferential speed rolling similar to that of the conventional equalized circumferential speed rolling, it is necessary to establish methods of controlling the setting of a rolling mill, and the thickness, the tension or the adaptability of a work during rolling.

2. Description of the Prior Art

The unequal circumferential speed rolling, in which the controlling parameters have a complicated influence on each other, requires a different control method from that for the equalized circumferential speed rolling. Though in the actual rolling, setting up is an important factor, no report has been found which explains the setting up of the unequal circumferential speed rolling.

In U.S. Pat. No. 4,145,902 a rolling method is disclosed in which a rolling load is reduced without using an RD (Rolling Drawing) rolling in which a sheet is wound around a roll. That is, in that method, the upper and lower work rolls are controlled such that the ratio of their circumferential speeds is equal to the ratio of elongation of a rolled work, the outlet speed of the work is equal to the circumferential speed of the higher speed roll, and its inlet speed is equal to the circumferential speed of the lower speed roll.

In U.S. Pat. No. 4,145,901, in addition to the patent above described, it is disclosed that a tension limit device and a computer are provided such that when the tension is beyond the limit value, the computer revises the roll position in correspondence with the rolling reduction, and further, in this patent, speed control and tension control over the rolling stands which are adjacent to each other are described.

In the present state of the art, however, in this kind of control, due to the mutual interference of other parameters, the setting of the speeds of a pair of work rolls and the setting of the rolling position are determined by trial and error.

In computer control, it is a great problem that a setting operation cannot easily be determined, and therefore establishment of a set-up control method suitable for computer control for the unequal circumferential speed rolling is desired.

SUMMARY OF THE INVENTION

Accordingly, it is an object of the invention to provide a set-up control method for an unequal circumferential speed rolling.

It is another object of the invention to control an unequal circumferential speed rolling by computing the set-up value from given rolling conditions without a trial-and-error operation.

This invention is characterized in that a setting value is computed from rolling conditions in a rolling schedule by using a certain model of an unequal circumferential speed rolling.

Further this invention is characterized in that the setting values of the circumferential speed of a higher speed roll, the circumferential speed of a lower speed roll and the roll position are computed by utilizing as input signals the values of the inlet and outlet thicknesses, forward tension and backward tension, the radii of the rolls, the frictional coefficient and the ratio of circumferential speeds of a pair of the rolls in a rolling stand.

In addition, this invention is characterized in that in the process of computing the setting values, the setting values of the circumferential speeds of a higher speed and a lower speed rolls and the roll position are computed such that these values meet the rolling conditions and satisfy both the load limit value and the tension limit value.

The above and other objects, features and advantages of the present invention will become clear from the following description of the preferred embodiments thereof, taken in conjunction with the accompanying drawings.

DESCRIPTION OF THE PREFERRED EMBODIMENTS

Basic conditions in the unequal circumferential speed rolling will first be described.

Figure 1:
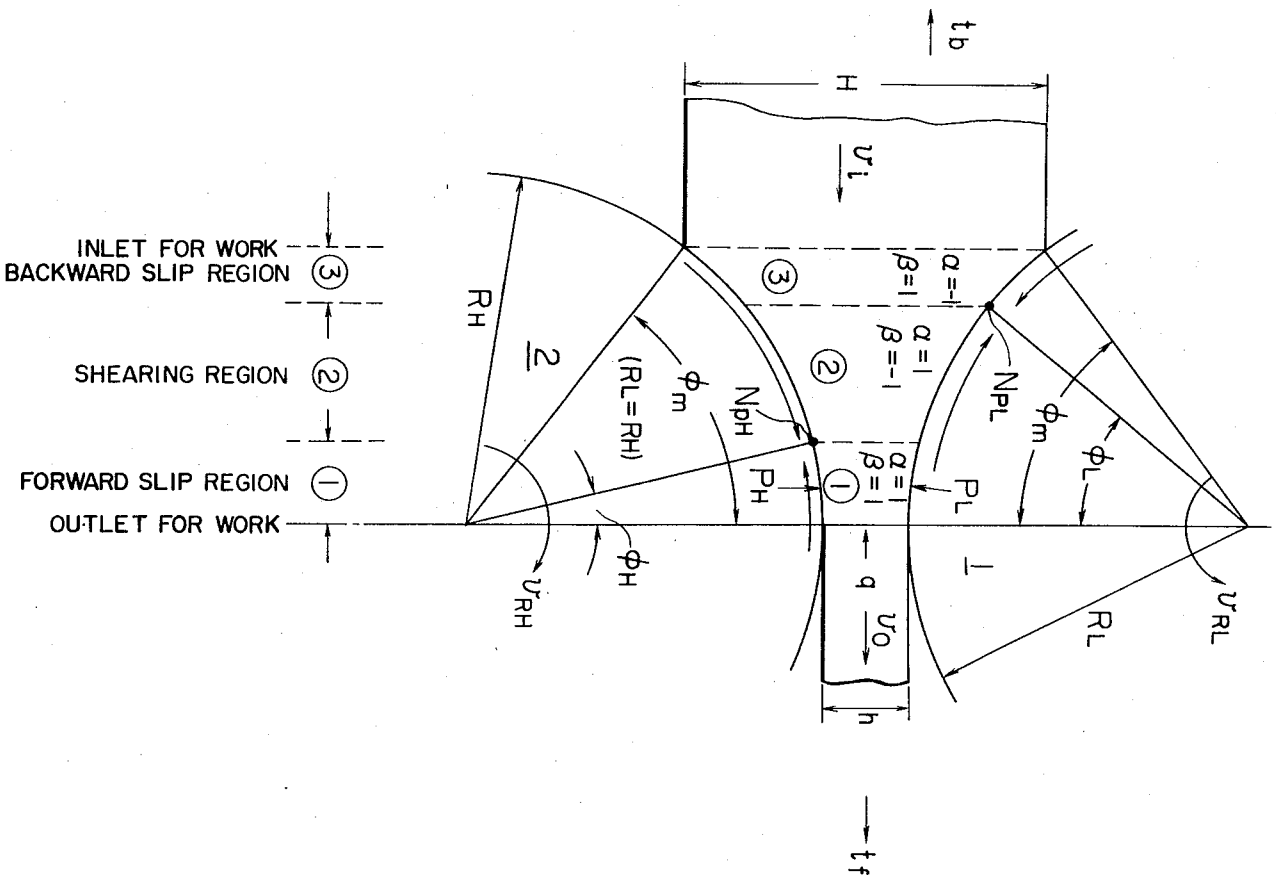
FIG. 1 shows a rolling process of an unequal circumferential speed rolling according to the invention.

FIG. 1 shows the rolling state directly under the work rolls in the unequal circumferential speed rolling. The reference numeral 1 represents an upper roll, and 2 a lower roll which together form a pair of work rolls. Each work roll has three regions, namely (1) a forward slip region, (2) a shearing region and (3) a backward slip region. The boundary between each region is called a neutral point, ($N_{PL}$, $N_{PH}$), and the circumferential speed of the higher speed work roll and the travelling speed of the work coincide with each other at the boundary between the forward slip region and the shearing region $N_{PH}$, and the circumferential speed of the lower speed work roll and the travelling speed of the work coincide with each other at the boundary between the backward slip region and the shearing region $N_{PL}$. $\phi_H$ is the angle formed between the line connecting the finishing point of rolling (outlet for the work) and the center of the higher speed roll and the line connecting the $N_{PH}$ and the center of the higher speed roll. $\phi_L$ is the angle formed between the line connecting the finishing point of rolling (outlet for the work) and the center of the lower speed roll and the line connecting the $N_{PL}$ and the center of the lower speed roll.

The equation of rolling load (the equation of perpendicular stress) per unit area in each region is introduced, as is already known, by the mutual relation between the balance of stress in the horizontal direction, the yield condition and the equilibrium of stress. That is, when the stress in the horizontal direction is q, the surface pressure of a higher speed roll is $p_H$, that of a lower speed roll is $P_L$, the radii of the rolls are $R_H$, $R_L$ respectively, and arbitrary contact angles are $\theta_L$, $\theta_H$ within the range of $\phi_m$ respectively, the following relation is established.

$$dQ=\phi_L(\sin\theta_L+\alpha\mu_L\cos\theta_L)R_L d\theta_L+p_H(\sin\theta_H+\beta\mu_H\cos\theta_H)R_H d\theta_H \quad (1)$$

In the above-described equation, $\alpha$ and $\beta$ are coefficients representing the direction of frictional force, and in the forward slip region (1), $\alpha=1$, $\beta=1$, in the shearing region $\alpha=1$, $\beta=-1$ and in the backward slip region $\alpha=-1$, $\beta=-1$.

The symbol Q denotes the total horizontal stress, which is expressed as follows if the thickness of the work at the angle $\theta$ is $h_\theta$.

$$Q=\int_0^{h_\theta} q\,dy \quad (2)$$

When the vertical stress is p, the relation between the surface pressure $p_L$, $p_H$ and p is as follows.

$$p=p_L(\cos\theta_L-\alpha\,\mu_L\sin\theta_L) \quad (3)$$
$$=p_H(\cos\theta_H-\beta\,\mu_H\sin\theta_H)$$

wherein, $\mu_L$, $\mu_H$ are the frictional coefficients of the lower speed roll and the higher speed roll respectively.

The thickness $h_\theta$ is expressed as follows.

$$h_\theta=h+R_L(1-\cos\theta_L)+R_H(1-\cos\theta_H) \quad (4)$$

wherein, h is the thickness at the outlet of the rolling mill.

The equation of the yield condition is as follows, as is already known (e.g. *The principle of Rolling Method and Application,* the 1969 edition, edited by the Iron And Steel Institute of Japan, published by Seibundo Shinkosha).

$$(q-p)^2+4\tau^2=4k_\tau^2 \quad (5)$$

wherein, $\tau$ is shearing force, and $k_\tau$ is shearing yield stress.

Furthermore, the following formula is given as the equation of stress equilibrium.

$$\frac{\partial q}{\partial x}+\frac{\partial \tau}{\partial y}=0,\ \frac{\partial p}{\partial y}+\frac{\partial \tau}{\partial x}=0 \quad (6)$$

wherein, x, y represent the horizontal and vertical coordinates respectively.

In this invention, the circumferential speeds of the upper and the lower work rolls and the roll position are set by solving the formulae described above.

The vertical stress p is also calculated by solving the above formulae. p is generally expressed as follows.

$$p=A(B+C) \quad (7)$$

wherein, the symbols A, B are functions of the angular position $\theta_L$, (or $\theta_H$), outlet thickness h, radii of rolls $R_L$, $R_H$, friction coefficients $\mu_L$, $\mu_H$, the shearing yield stress $k_\tau$, and direction coefficients $\alpha$, $\beta$, and the symbol C is an integration constant. The integration constant C is determined depending on the boundary condition in each region. At the outlet ($\theta_L=0$) of a rolling mill, the horizontal stress q and the outlet unit tension $t_f$ is balanced, namely $q=-t_f$, and t the inlet ($\theta_L=\phi_m$) of the rolling mill, the horizontal stress and the inlet unit tension $t_b$ is balanced, namely $q=-t_b$. Therefore, at the rolling ends on both inlet and outlet sides, the following relation is established.

$$\text{If } \theta_L=0,\ p=2k_\tau-t_f \quad (8)$$
$$\text{If } \theta_L=\phi_m,\ p=2k_\tau-t_b$$

When the forward slip region, the shearing region and the backward slip region are expressed as the suffix numbers 1, 2, and 3, from the formulae (7) and (8), $C_1$ and $C_3$ becomes as follows.

$$C_1=(2k_\tau-t_f)/A_1(0)-B(0) \quad (9)$$
$$C_3=(2K_\tau-t_b)/A_3(\phi_m)-B(\phi_m)$$

wherein, A and B are functions of $\theta_L$ and expressed as A ($\theta_L$), B ($\theta_L$). The total contact angle $\phi_m$ is determined by the following formula using the formula (4). The inlet thickness is represented by H.

$$\phi_m=\sqrt{2\frac{R_H(H-h)}{R_L(R_L+R_H)}} \quad (10)$$

The real number term $C_2$ of the distributed load curve in the shearing region will be explained below.

The distributed load curve is continuous at the neutral points $\theta_L=\phi_L$, and $\theta_H=\phi_H$. That is $$p_1\left(\frac{R_H}{R_L}\phi_H\right)=p_2\left(\frac{R_H}{R_L}\phi_H\right) \quad (11)$$

$$p_2(\phi_L)=p_3(\phi_L) \quad (12)$$

The formula (11) is introduced by the condition that $R_L\theta_L=R_H\theta_H$.

Therefore, $$A_1\left(\frac{R_H}{R_L}\phi_H\right)\left\{B_1\left(\frac{R_H}{R_L}\phi_H\right)+C_1\right\}= \quad (13)$$

-continued $$A_2\left(\frac{R_H}{R_L}\phi_H\right)\left\{B_2\left(\frac{R_H}{R_L}\phi_H\right)+C_2\right\}$$

$$A_2(\phi_L)\{B_2(\phi_L)+C_2\}=A_3(\phi_L)\{B_3(\phi_L)+C_3\} \quad (14)$$

wherein, $C_2$, $\phi_L$ and $\phi_H$ are unknown.

Since the volume speed of the work at the neutral points and the volume speed at the outlet of the rolling mill are equal, the following formulae are obtained.

$$\left.\begin{aligned} V_{RH}\cdot h(\phi_H) &= V_o\cdot h \\ V_{RL}\cdot h(\phi_L) &= V_o\cdot h \end{aligned}\right\} \quad (15)$$

wherein, $V_{RH}$ is the circumferential speed of the higher speed roll, $V_{RL}$ is the circumferential speed of the lower speed roll and $V_o$ is the outlet speed of the work.

The thickness of the work at the angle $\theta$, $h(\theta)$, is obtained by the formula (4). Therefore, $$h(\phi_H)\approx h+\tfrac{1}{2}R_H\left(1+\frac{R_H}{R_L}\right)\phi_H^2 \quad (16)$$

$$h(\phi_L)\approx h+\tfrac{1}{2}R_L\left(1+\frac{R_L}{R_H}\right)\phi_L^2$$

Rearranging the formulae (15), (16), the following formula is obtained:

$$\frac{V_{RL}}{V_{RH}}=\frac{h+\tfrac{1}{2}R_H\left(1+\frac{R_H}{R_L}\right)\phi_H^2}{h+\tfrac{1}{2}R_L\left(1+\frac{R_L}{R_H}\right)\phi_L^2} \quad (17)$$

The relation between the two neutral points are obtained by providing the speed ratio of the upper and lower rolls in the formula (17). Accordingly, by solving the formulae (13), (14) and (17), $C_2$, $\phi_H$ and $\phi_L$ are determined.

As is obvious from the above explanation, the distributed load curve (7) in each rolling region, and further the neutral points $\phi_H$, $\phi_L$, are determined by providing the inlet thickness H, inlet unit tension $t_b$, outlet thickness h, outlet unit tension $t_f$ and the speed ratio of the upper and the lower rolls. Furthermore, on the basis of $\phi_H$ and $\phi_L$, the forward slip rate of the higher speed roll $f_H$, and the forward slip rate of the lower speed roll $f_L$ are obtained by the following formulae:

$$\left.\begin{aligned} f_H &= \tfrac{1}{2}\frac{R_H}{h}\left(1+\frac{R_H}{R_L}\right)\phi_H^2 \\ f_L &= \tfrac{1}{2}\frac{R_L}{h}\left(1+\frac{R_L}{R_H}\right)\phi_L^2 \end{aligned}\right\} \quad (18)$$

Furthermore, if the distributed load curve is determined, the total roll force F is obtained by integrating p in each region, as is shown below:

$$F=\left[\int_0^{R_H\phi_H/R_L}P_1(\theta_L)d\theta_L+\int_{R_H\phi_H/R_L}^{\phi_L}p_2(\theta_L)d\theta_L+\int_{\phi_L}^{\phi_m}p_3(\theta_L)d\theta_L\right]W \quad (19)$$

wherein, W is the width of the work.

By applying Hooke's Law, the mutual relation between the roll position S, the total rolling force F and the outlet thickness h is expressed as follows:

$$h=S+F/M+S_0 \quad (20)$$

wherein, M is the rigidity coefficient of the rolling mill, and $S_0$ is the zero adjusting value.

Figure 2:
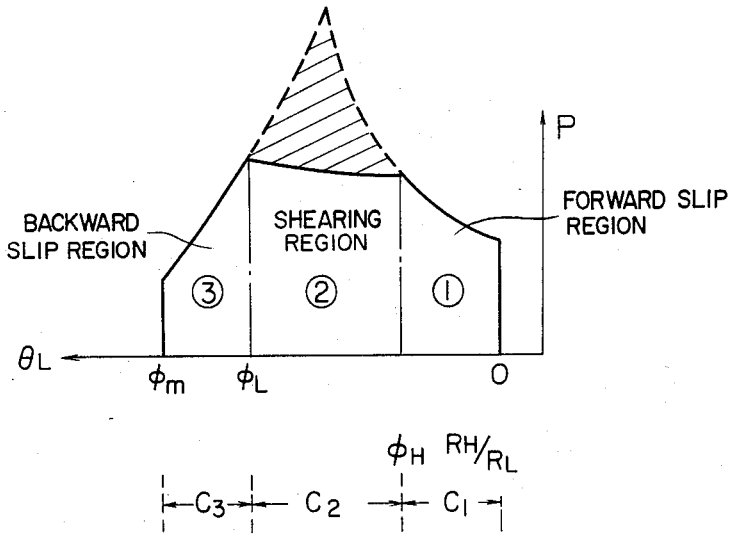
FIG. 2 shows load distribution over the work during the rolling shown in FIG. 1.
Figure 3:
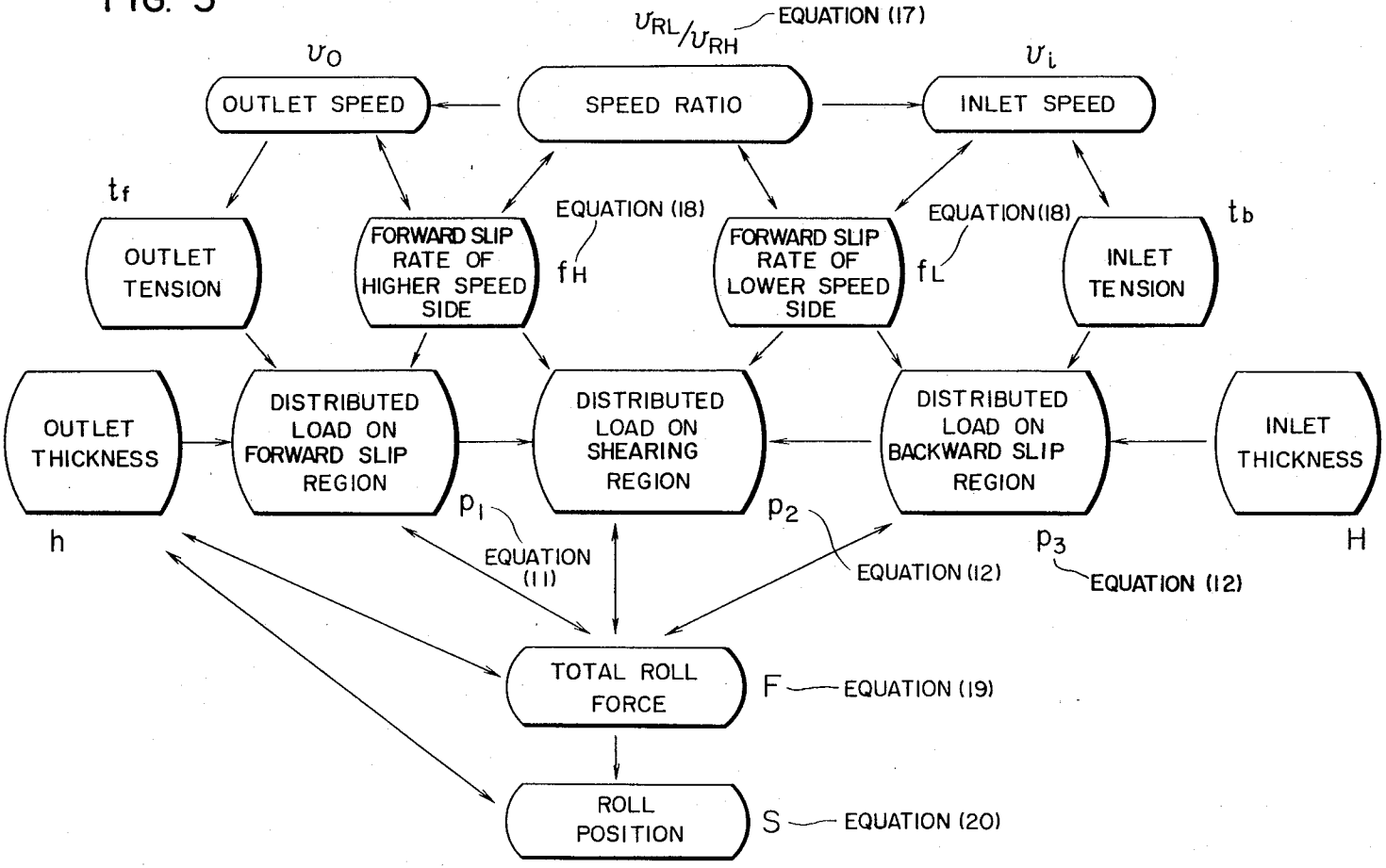
FIG. 3 schematically shows the mutual relation between various factors of a model of an unequal circumferential speed rolling.

FIG. 2 shows load distribution on the work during rolling in accordance with the invention. The solid line shows the distribution of load in the case of unequal circumferential speed rolling, and the dotted line the distribution of load in the case of ordinary equalized circumferential speed rolling. This Figure shows that the load is reduced by the unequal circumferential speed rolling. However, since, in the unequal circumferential speed rolling, the relations described above have a complicated influence on one another, what is called set-up control is very difficult. FIG. 3 schematically shows these relations.

Figure 4:
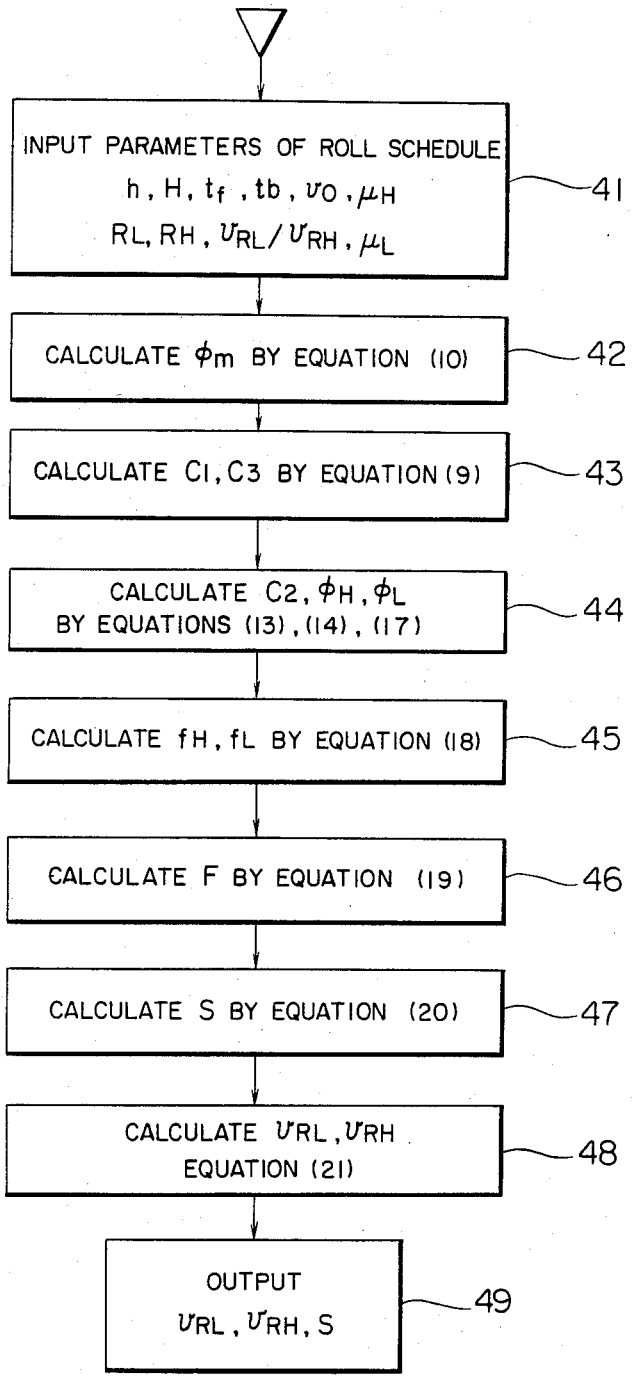
FIG. 4 is an example of computation of the set-up values.

An example of the calculation of the setting values in set-up control of rolling is shown in FIG. 4.

The setting values of the speeds of the rolls are determined by using the target value $V_o$ of the outlet speed of the work as below:

$$\left.\begin{aligned} V_{RH} &= \frac{V_o}{1+f_H} \\ V_{RL} &= \frac{V_o}{1+f_L} \end{aligned}\right\} \quad (21)$$

By putting the parameters in a rolling schedule, step 41, in accordance with the flowchart shown in FIG. 4, and following the steps 42 to 48, the roll position S of the rolling mill and the setting values of the rotating speed $V_{RH}$, $V_{RL}$ of the upper and lower rolls can be calculated.

Figure 5:
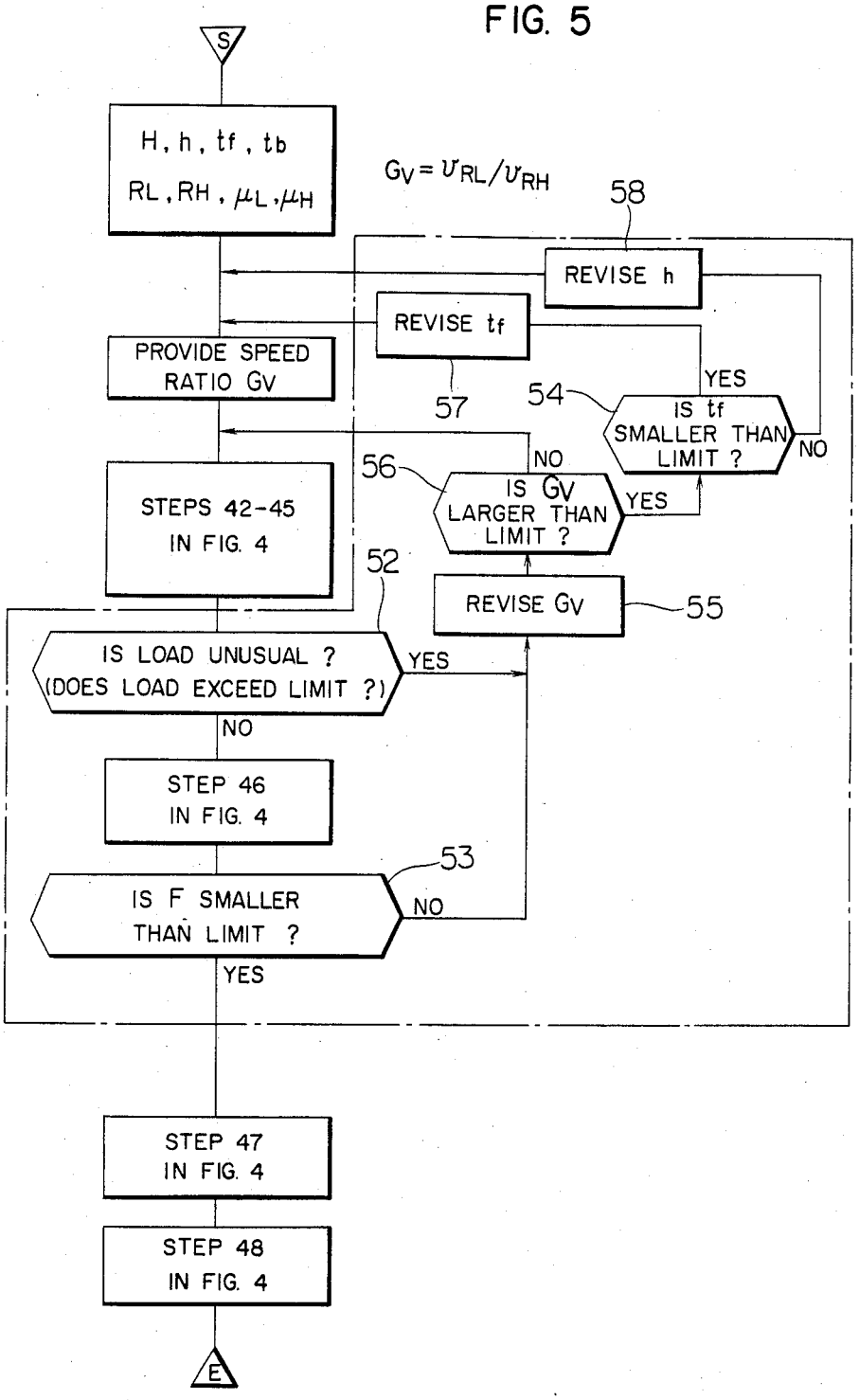
FIG. 5 is a flowchart of an example of computation of the set-up values under the load limit and tension limit.

Actually, however, since the neutral points and load are sometimes unusual, the values of the circumferential speeds of the upper and the lower rolls ($V_{RH}$, $V_{RL}$) and the roll position (S) are determined by calculation within the range of the permissible load values after revision of the speed ratio and the forward tension as is shown in the flowchart of FIG. 5. In other words, steps 52 to 54 are added in FIG. 5. For example, in the step 52, judgement is made as to whether $0<\phi_L<\phi_m$ and $0<\phi_H<\phi_m$, and if the conditions are not satisfied, the value $G_V$ is revised. Further if $G_V$ is greater than the limit value, $t_f$ is revised. However, where $t_f$ has already exceeded the limit value, h is revised.

Figure 6:
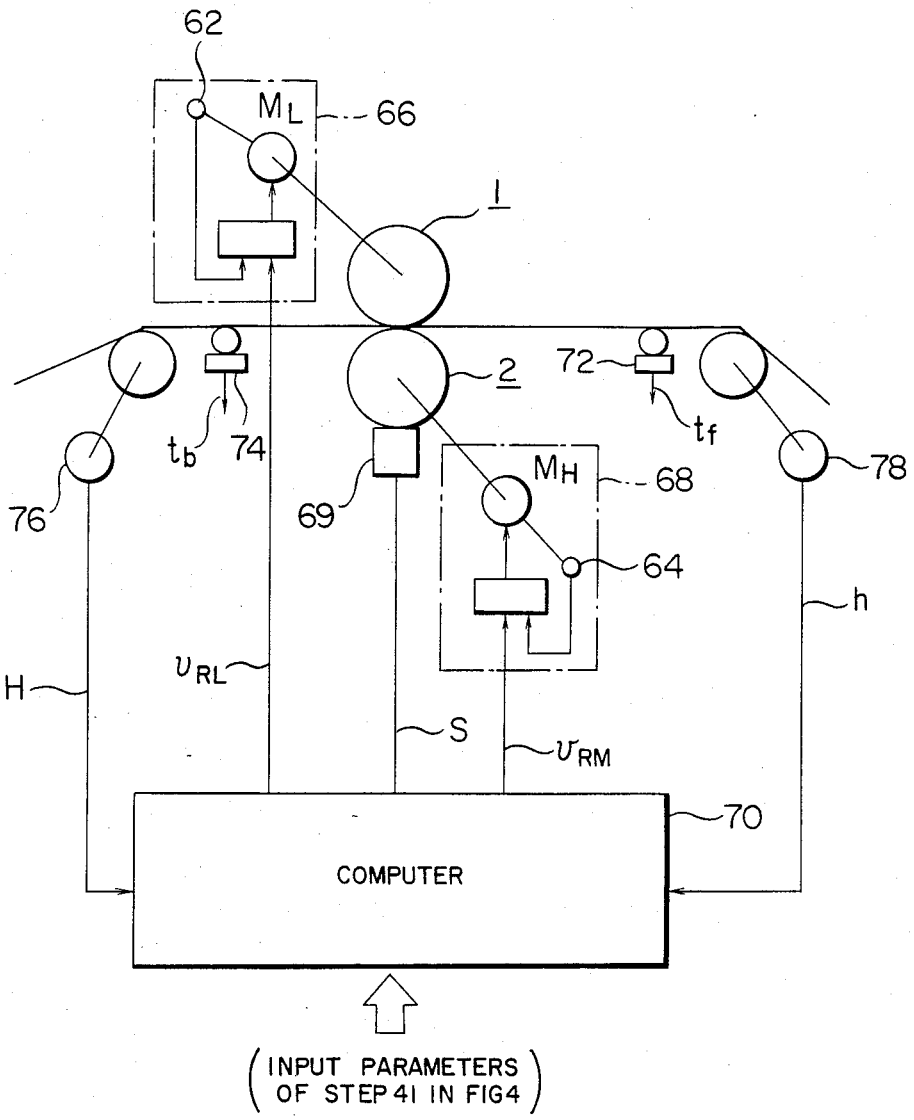
FIG. 6 is a block diagram showing the input and output relation in the case of this invention being applied to an actual rolling stand.

In FIG. 6 is shown the control block diagram used in the case of actual control. In the Figure, parameters are input into a computer 70 as in the step 41 shown in FIG. 4. The reference numerals 66, 68 show the speed adjusting devices of the upper and the lower rolls respectively. The symbols $M_L$, $M_H$ represent the drive motors of the upper and the lower rolls respectively, and 62, 64 are their speed detectors, 72 a forward tension detector, 74 a backward tension detector, 76 an inlet speed detector, 78 an outlet speed detector, and H, h the signals output from the inlet speed detector 76 and the outlet speed detector 78 respectively.

The computer 70 calculates the setting values of the speed of the upper roll $V_{RH}$, the speed of the lower roll $V_{HL}$, and the roll position S as in the flowchart in FIG. 5, and outputs these values. The numeral 69 denotes a roll position adjusting device.

The control effected during rolling will now be explained. The parameters which can be measured during rolling are generally roll position, rolling force, the speeds of the upper and the lower rolls, and inlet and outlet tension $t_f$, $t_b$. The outlet thickness h may be measured by an X-ray thickness detector or may be calculated by the above-described formula (20). As for the inlet thickness, in the case of a tandem rolling mill, a value can be used which is obtained by delaying the value of the outlet thickness in the pre-stage stand by the time taken for transferring the work. By applying these measured values to the relations shown in FIG. 3, and modelling as described before, the forward slip rate of the higher and the lower speed rolls and the distributed load in each region can be calculated.

It is necessary to separate thickness control from tension control. Thickness is controlled by measuring the inlet tension, the outlet tension and the inlet thickness and calculating the below-described matters in relation to the target value and the measured value of the outlet thickness.

The above-described formulae (13) and (14) are first provided. The total rolling force $F_A$ and the total rolling force in relation to the target value of the outlet thickness h are next obtained from the formula (20), and the formula (19) is introduced. By solving the formulae (13), (14) and (19), which are simultaneous equations having $C_2$, $\phi_H$ and $\phi_L$ as unknown quantities, $C_2$, $\phi_H$ and $\phi_L$ are obtained. The speed ratio is determined from the formula (17) by using the $\phi_H$ and the $\phi_L$ obtained above. The difference between the speed ratio in relation to the measured outlet thickness (namely, actual speed ratio) and the speed ratio in relation to the target value of the outlet thickness is finally determined and this result is used as the amount of revision of the speed ratio of the upper and the lower rolls. If $\phi_H<0$ and/or $\phi_L>\phi_m$, the roll position or the target value of tension is revised such that $\phi_H>0$ and $\phi_L<\phi_m$.

As to tension control, the outlet speed is controlled based on tension deviation.

In the transient process in which the equalized circumferential speed rolling state is switched over to the unequal circumferential speed rolling state, the speed ratio is changed while the thickness and the tension are maintained at the target values (the target values of the thickness and the tension, however, are sometimes different between in the equal speed condition and in the unequal speed condition, and therefore, these target values are to be changed from the equalized circumferential speed rolling state to the unequal circumferential speed rolling state in accordance with the change in the ratio of the speeds).

Figure 7A:
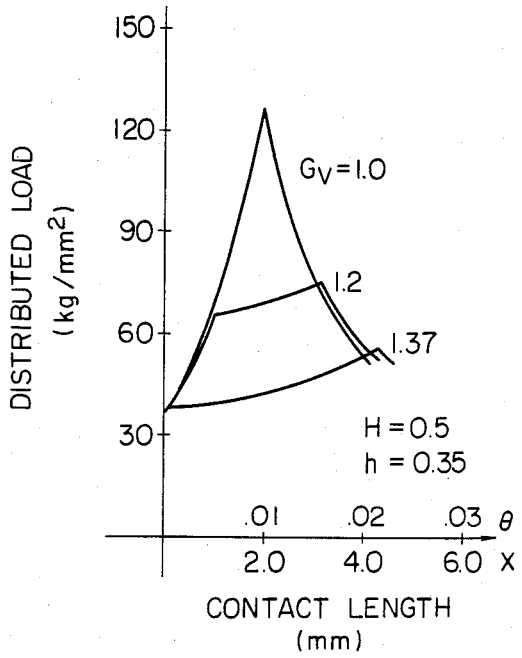
FIGS. 7A to 7D show an example of simulation by using the model in FIG. 3.
Figure 7B:
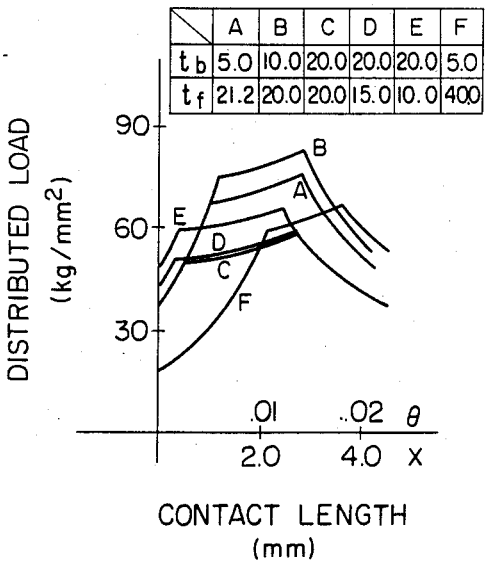
Figure 7C:
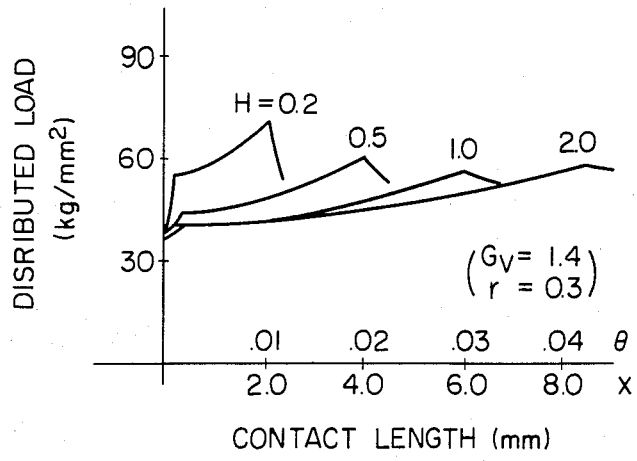
Figure 7D:
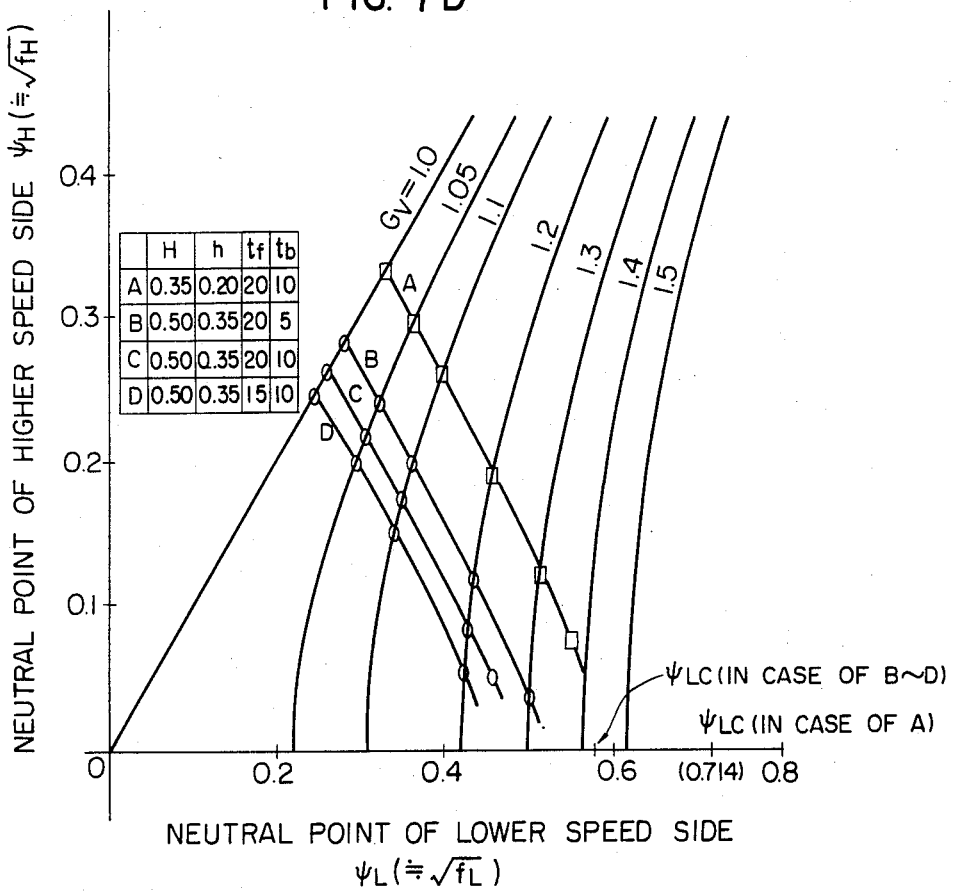

FIGS. 7A to 7D show an example of simulation by the modelling described above. FIG. 7A shows the distributed load obtained when the ratio of the circumferential speed of the rolls are varied. The curve indicated by $G_V=1.0$ shows the distributed load in the case of the conventional equalized circumferential speed rolling. From this Figure, it is clear that as the ratio of the circumferential speed of the rollings increases, the distributed load decreases. FIG. 7B shows the distributed load obtained when the forward and backward tensions are varied and FIG. 7C shows the distributed load obtained when the inlet thickness of the work is varied. FIG. 7D shows the fluctuation of the neutral points on the upper and the lower speed rolls. In FIG. 7D, $\Psi_{LC}$ is limit values in the case of A and in the case of B–D, and correspond to $\phi_m$ in FIG. 1. (Here, since there is no one-to-one correspondence, the symbol $\Psi_L$ is now used rather than $\phi_m$. $\Psi_L$ is the value approximately equal to the root of the forward slip rate $f_L$, $f_H$.) For example, in the case of A, if the rolling condition is $\Psi_L>\Psi_{LC}$, or $\Psi_H<0$, an unstable slip phenomenon is generated. The same is to be said for the cases of B to D.

While there has been described what is at present considered to be the preferred embodiment of the invention, it will be understood that various modifications may be made therein, and it is intended that the appended claims cover all such modifications as fall within the true spirit and scope of the invention.

What is claimed is:

1. A set-up method for control of unequal circumferential speed rolling in which a work to be rolled is made to pass between at least one pair of rolls each of which is driven at a different circumferential speed, said set-up method comprising the steps of:

calculating angles ($\phi_H$, $\phi_L$) of neutral points on a higher speed roll and a lower speed roll in accordance with at least diameters of the respective rolls of said pair of rolls, predetermined outlet thickness of said work and a ratio of the circumferential speeds of said higher speed roll and said lower speed roll;

calculating forward slip rates ($f_H$, $f_L$) of said higher speed roll and said lower speed roll in accordance with said calculated angles of neutral points of said rolls, said diameters of said rolls and said outlet thickness of said work;

calculating a total rolling force in accordance with a load distribution curve when said calculated angles of neutral points of said rolls are not greater than a contact angle ($\phi_m$) of said work and said rolls;

calculating a circumferential speed of said higher speed roll and a circumferential speed of said lower speed roll in accordance with said calculated forward slip rates of said higher speed roll and said lower speed roll and a target outlet speed of said work;

calculating roll positions for said rolls in accordance with said calculated total rolling force and said target speed of said work; and setting up and controlling said rolls in accordance with said calculated circumferential speeds and roll positions of said rolls.

2. The method according to claim 1, further comprising the steps of correcting said ratio of the circumferential speeds of said rolls when said calculated total rolling force is greater than a predetermined allowable limit value, repeatedly correcting said ratio of the circumferential speeds of said rolls and calculating said total rolling force until the calculated total rolling force becomes smaller than said limit value.

3. The method according to claim 2, further comprising the steps of providing a predetermined forward tension value correcting said forward tension value when said calculated total rolling force is greater than said predetermined allowable limit force value, repeatedly correcting said forward tension value and calculating said total rolling force until said calculated total rolling force becomes smaller than said limit force value.

4. The method according to claim 3, further comprising the steps of correcting said target outlet speed of said work when said calculated total rolling force is greater than said predetermined allowable limit value, repeatedly correcting said target outlet speed of said work and calculating said total rolling force until said calculated total rolling force becomes smaller than said limit value.

5. The method according to claim 1, further comprising the step of passing the work to be rolled between said at least one pair of rolls without causing said work to pass along the periphery of one of said pair of rolls before entering the work area between said pair of rolls and after exiting the work area.

* * * * *